US005924203A

United States Patent [19]

Huang

[11] Patent Number: 5,924,203

[45] Date of Patent: Jul. 20, 1999

[54] RETRACTABLE KNIFE DEVICE

[76] Inventor: Jung-Sheng Huang, F.1 No. 27 Lane 35 Chia-Ho Rd, Ta-Chia Chen Taichung Hsien, Taiwan

[21] Appl. No.: 09/027,279

[22] Filed: Feb. 20, 1998

Related U.S. Application Data

[51] Int. Cl.[6] ..... B26B 1/08; B26B 5/00

[52] U.S. Cl. ..... 30/142; 30/123; 30/162; 30/299

[58] Field of Search ..... 30/123, 142, 143, 30/136, 136.5, 162, 335, 336; 7/158, 118–120

[56] References Cited

U.S. PATENT DOCUMENTS

| | | | |
|---|---|---|---|
| 736,741 | 8/1903 | Klemm | 30/143 |
| 4,570,342 | 2/1986 | Baum | 30/136 X |
| 4,713,885 | 12/1987 | Keklan et al. | 30/335 X |
| 4,955,138 | 9/1990 | Henke et al. | 30/335 X |
| 5,093,994 | 3/1992 | Karas | 30/162 X |
| 5,617,635 | 4/1997 | Berns | 30/162 |
| 5,778,536 | 7/1998 | West | 30/143 X |

*Primary Examiner*—Douglas D. Watts
*Attorney, Agent, or Firm*—Rosenberg, Klein & Bilker

[57] ABSTRACT

A retractable knife device includes a first and a second blade respectively and retractably received in two ends of a casing of the tool. A connecting device is connected between the two blades and has a knob slidably disposed to a side of the casing. The first blade is moved to extend from the casing by a trigger device and the second blade is moved to extending from the casing by moving a pin member connected thereto which slidably extends from the casing. A spring has one end thereof fixedly connected to the casing and the other end thereof connected to the first blade. The connecting device ensures that only one of the first blade and the second blade can be moved to extend from the casing when in use.

6 Claims, 8 Drawing Sheets

RETRACTABLE KNIFE DEVICE

BACKGROUND OF THE INVENTION

1. Field of the Invention

The present invention relates to a retractable knife device and, more particularly, to an improved retractable knife device having two different blades retractable received in two ends of a casing and the two blades are connected by a connecting device so as to ensure only one of the two blades extends from the casing when in use.

2. Brief Description of the Prior Art

Conventional retractable knife device generally has a casing with a front opening so as to retractably receive a blade in the casing via the front opening and the blade is connected to a movable member slidably disposed to the casing such that the blade is moved according to an operation of the movable member. This type of casing is a flat and elongate member so as to be conveniently held by the user. However, the casing has a unique blade can be used, that is to say, if the user wants to use other type of blade or tool, such as a scraper, he/she has to put the knife down and takes the scraper. Therefore, the user carries various and many tools with him/her when in work and that is inconvenient for the user. Furthermore, the blade extending from the casing could hurt the user's hand when the user changes another different tool if the user does not retract the blade into the casing. Unfortunately, the user usually will not retract the blade into the casing when he/she changes another tool.

The present invention intends to provide an improved retractable knife device which has at least two different blades connected by a connecting device so that only one blade is controlled to extend a casing receiving the two blades so as to mitigate and/or obviate the above-mentioned problems.

SUMMARY OF THE INVENTION

In one aspect of the present invention, there is provided a retractable knife device comprising a casing having a first end into which a first member is retractably received and a second end into which a second member is retractably received. A connecting device is connected between the first member and the second member, and has a knob slidably disposed to a side of the casing. A trigger means includes a trigger member and a plate transversely connected to one of two ends of the trigger member. The plate is pivotally received in the casing and has a first slot defined therethrough into which a stub extending from the first member is movably received so that the first member is moved by pulling the trigger member. A spring has a first end thereof fixedly connected to the casing and a second end thereof connected to the first member.

The casing has an upper part through which a second slot is defined, a pin member movably extending through the second slot and a lower end of the pin member fixedly connected to the second member so as to move the second member to extend from the second end of the casing by moving the pin member.

It is an object of the present invention to provide a retractable knife device having a connecting device disposed between two blades which are retractably received in a casing of the retractable knife device.

It is another object of the present invention to provide a retractable knife device which ensures that only one of two blades can be extended from the casing when in use.

It is a further object of the present invention to provide a retractable knife device wherein a first blade thereof is moved by pulling a trigger means.

It is still another object of the present invention to provide a retractable knife device wherein a second blade thereof is limited by a limit member which can be removed from a recess defined in the second blade by a pulling action.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
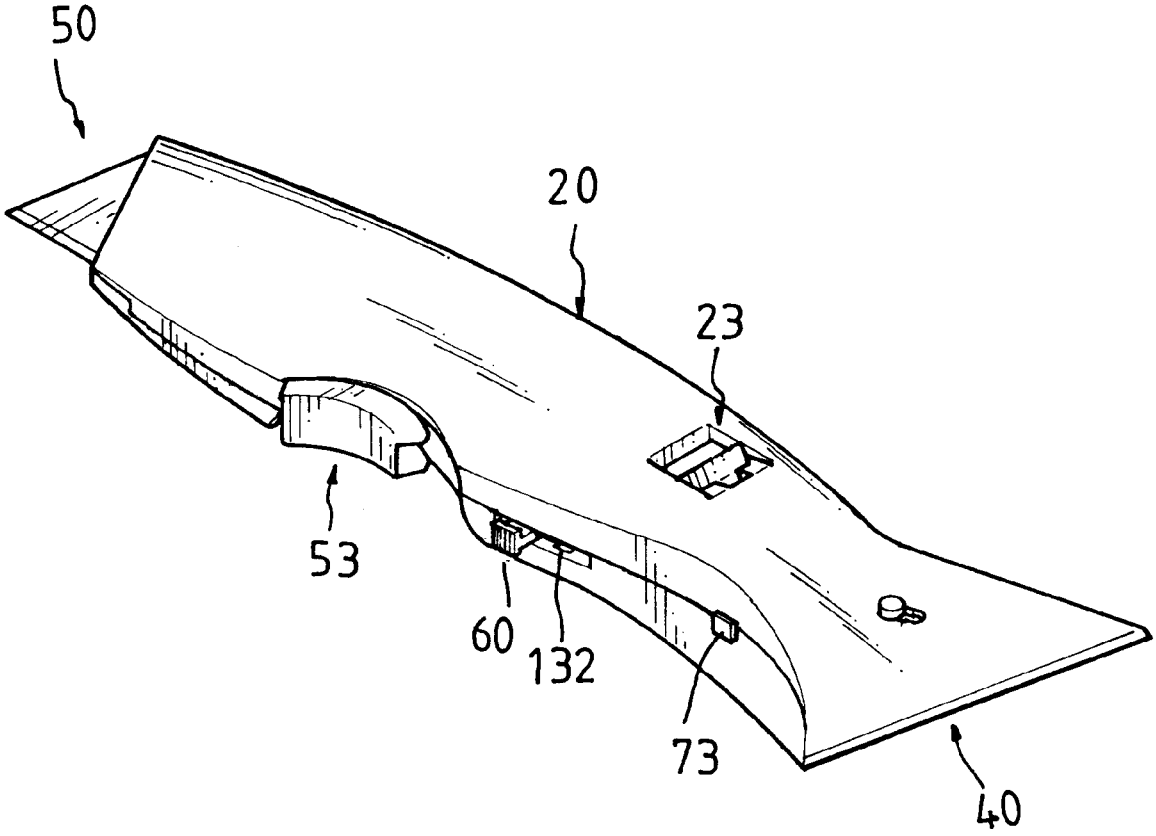
FIG. 1 is a perspective view of a retractable knife device in accordance with the present invention.
Figure 2:
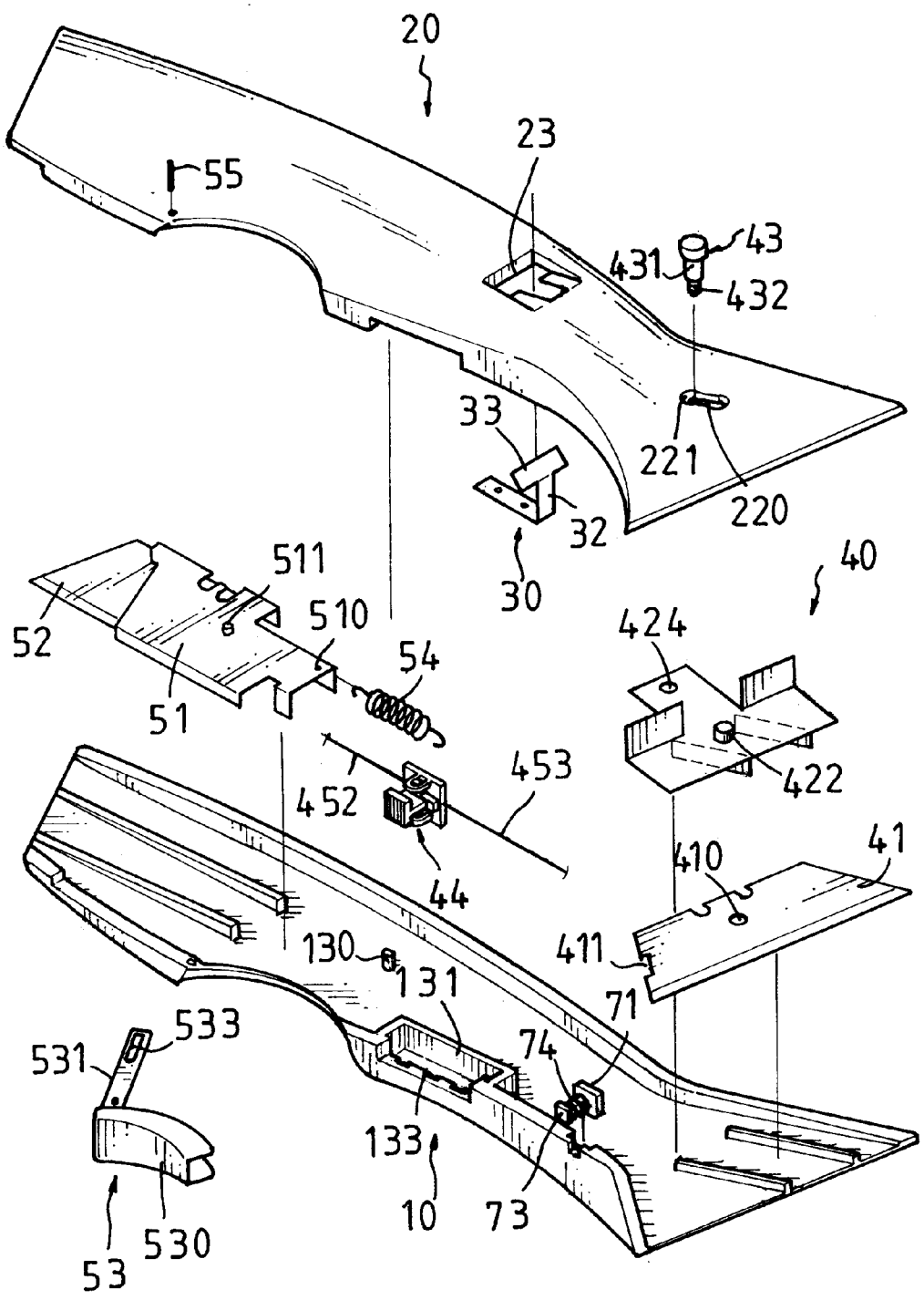
FIG. 2 is an exploded view of the retractable knife device in accordance with the present invention.
Figure 3:
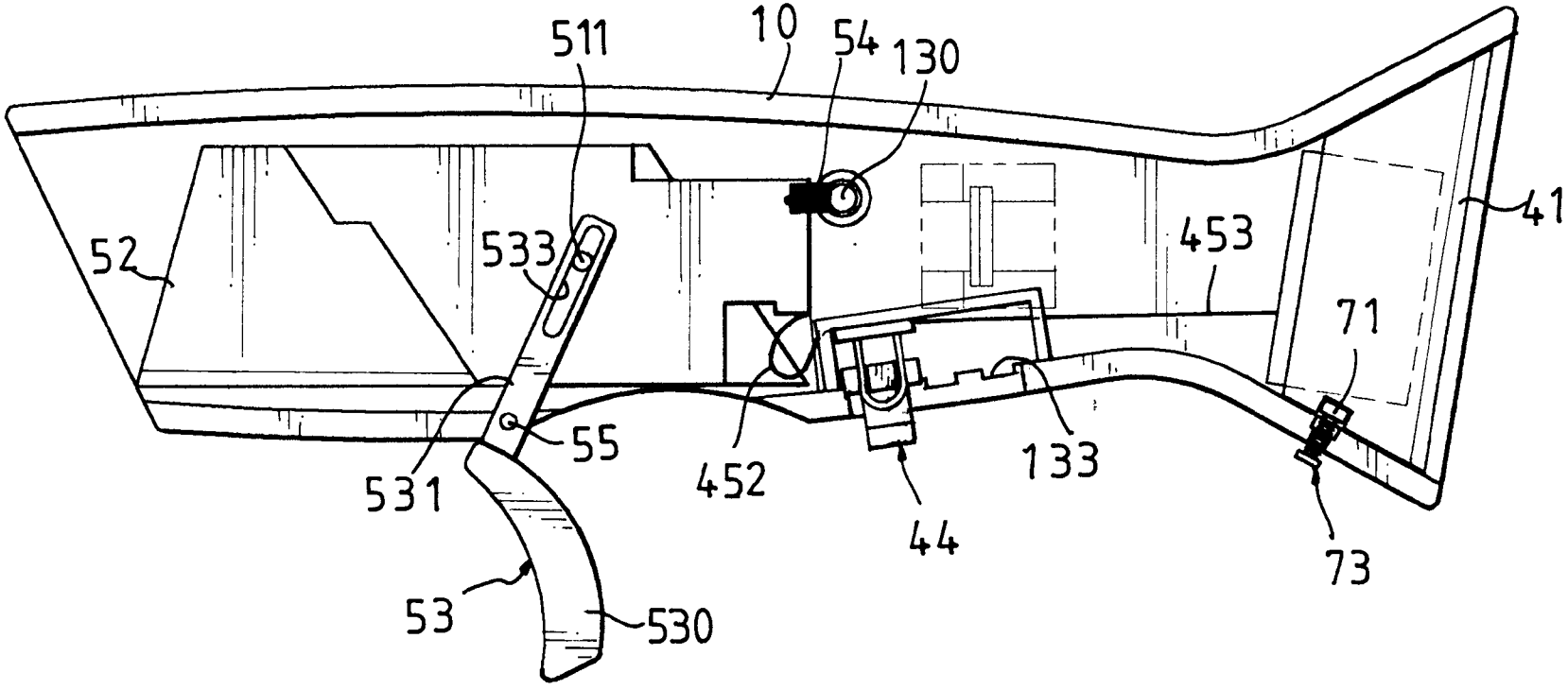
FIG. 3 is a side elevational view, partly removed, of the retractable knife device wherein the two blades are both received in the casing.

Referring to the drawings and initially to FIGS. 1 through 3, a retractable knife device in accordance with the present invention generally includes a casing composed of an upper part 20 and a lower part 10, and having a first end into which a first blade 52 is retractably received and a second end into which a second blade 41 is retractably received. The upper part 20 has an aperture 23 defined by a T-shaped inner periphery. An engaging member,30 extends from the lower part 10 and has a vertical portion 32 and a transverse portion 33 which is perpendicularly connected to a top of the vertical portion 32 such that the vertical portion 32 extends through the aperture 23 and the transverse portion 33 is rested across the inner periphery defining the aperture 23. The lower part 10 of the casing has a plurality of grooves 133 defined in an inner side of a side thereof and a wall 131 extending upwardly from the lower part 10 so as to receive a connecting device 44 between the wall 131 and the inner side of the lower part 10. The first blade 52 is connected to a body 51 from which a stub 511 extends and a hole 510 is defined through the body 510. A spring 54 has a first end thereof fixedly connected to a boss 130 extending from the lower part 10 and a second end thereof hooked to the hole 510 of the body 51. The second blade 41 being a scraper has a center hole 410 defined therethrough and is connected to a body 40 which is T-shaped and has a stud 422 extending upwardly therefrom so as to be received in the center hole 410, and an engaging hole 424 defined in an end opposite to the second blade 41. The second blade 41 further has a recess 411 defined in a side thereof.

Figure 6:
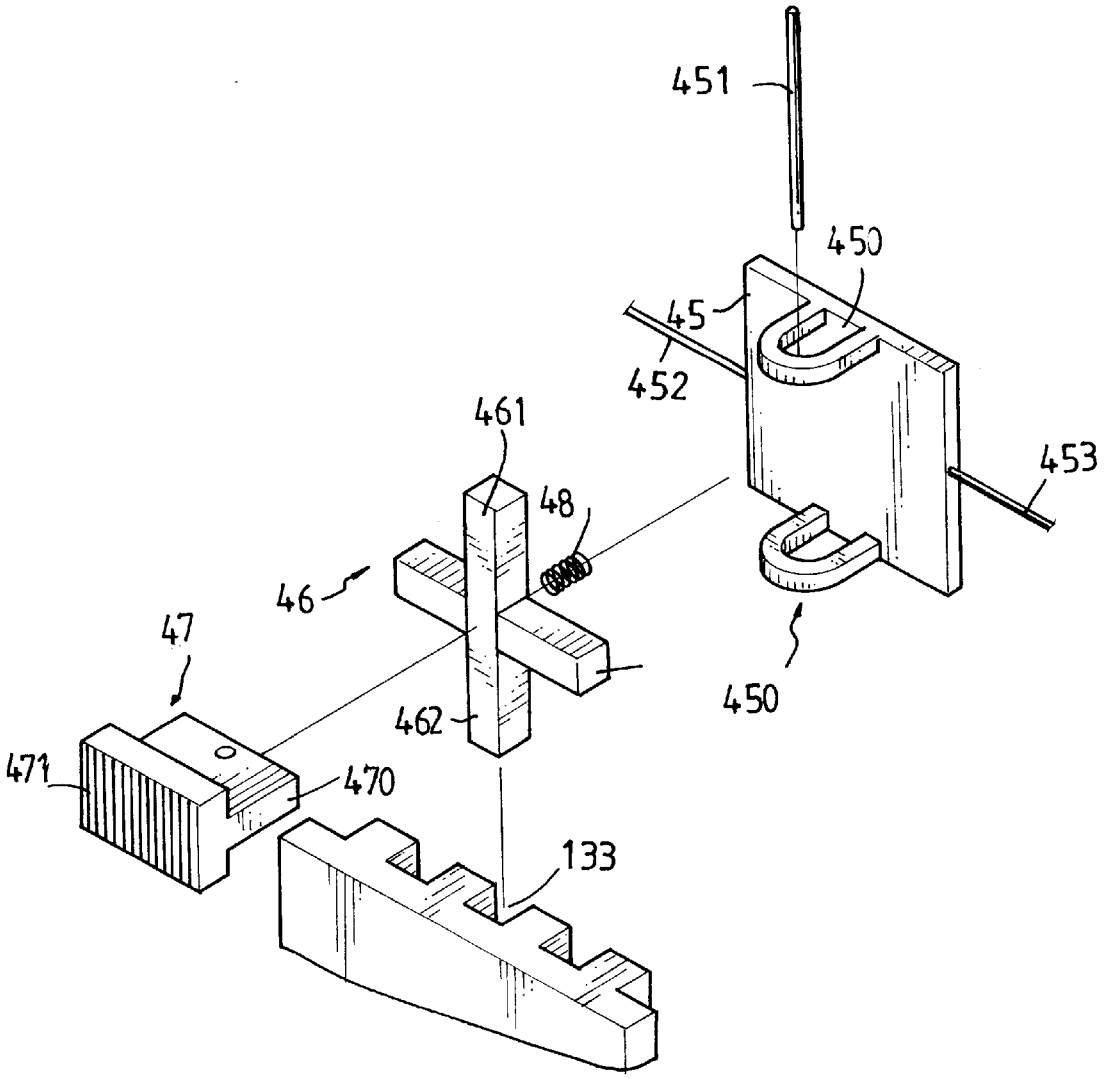
FIG. 6 is an exploded view of the connecting device in the retractable knife device in accordance with the present invention.

The connecting device 44 is connected between the first blade 52 and the second blade 41 so that only one of the first and the second blade 52, 41 extends from the casing when in use. Referring to FIG. 6, the connecting device 44 includes a knob 47 which has a pushing portion 471 and rib 470 extending from the knob 47, a board 45 having two ring members 450 respectively disposed to two ends thereof, a middle member 46 disposed between the rib 470 of the knob 471 and the board 45 with a spring 48 disposed between the middle member 46 and the board 45. Two protrusions 461, 461 respectively extend in opposite with each other from the middle member 46 and the protrusion 462 received in one of the grooves 133. A pin 451 extends through the two ring members 450 and the knob 471 so that the protrusion 462 is able to be lowered and moved to another groove 133 by operating the pushing portion 471 which is slidably disposed to the side of the casing. The board 45 has a first flexible rope 452 extending therefrom which is fixedly connected to the body 51 of the first member 52 and a second flexible rope 453 extending therefrom which is fixedly connected to the body 40 of the second member 41.

A trigger means 53 includes a trigger member 530 and a plate 531 which is transversely connected to one of two ends of the trigger member 530. The plate 531 is pivotally received in the casing 20 by a pin 55 and has a first slot 533 defined therethrough into which the stub 511 extending from the body 51 of the first blade 52 is movably received so that the first member 52 is moved to extend from the casing by pulling the trigger member 530, and when the trigger member 530 is released, the first blade 52 together with the body 51 are retracted into the casing by the spring 54.

The upper part 20 further has a second slot 221 defined therethrough for a pin member 43 movably extending through the second slot 221 and a lower end 432 of the pin member 43 is fixedly engaged with the engaging hole 424 of the body 40 of the second blade 41 such that the second blade 41 is moved to extend from the second end of the casing 20 by moving the pin member 43. The second slot 220 has two enlarged end 221 and the pin member 43 has a shank 431 which is larger than that of the lower end 432 such that the pin member 43 is lifted to receive the lower end 432 in the enlarged end 221 and the pin member 43 is then movable in the second slot 220 to another enlarged end.

A limit member 71 is movably received in the recess 411 and has an end 73 exposed on the side of the casing. A spring 74 is mounted to a shank connected between the limit member 71 and the end 73, and contacts against the side of the lower part 10 so that when the limit member 71 received in the recess 41, the second member 41 is limited to be moved.

Figure 4:
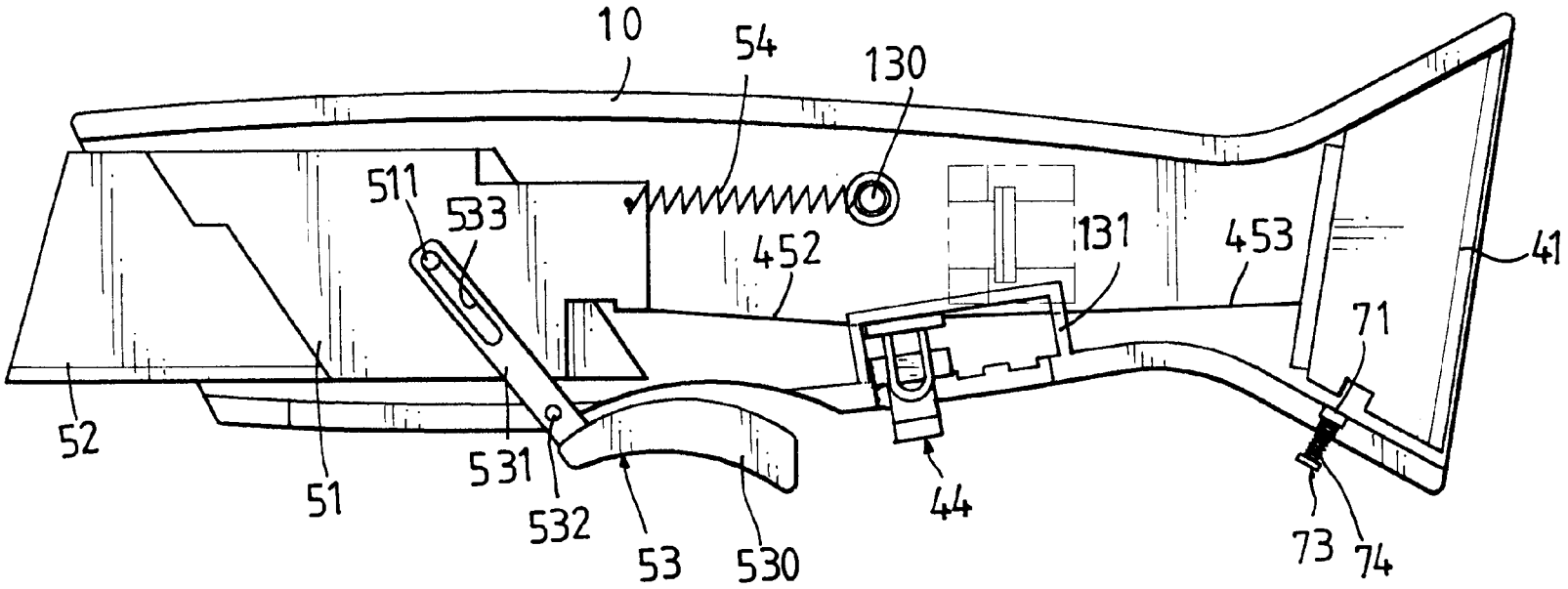
FIG. 4 is a side elevational view, partly removed, of the retractable knife device wherein the trigger member is pulled to move the first blade out from the casing.
Figure 5:
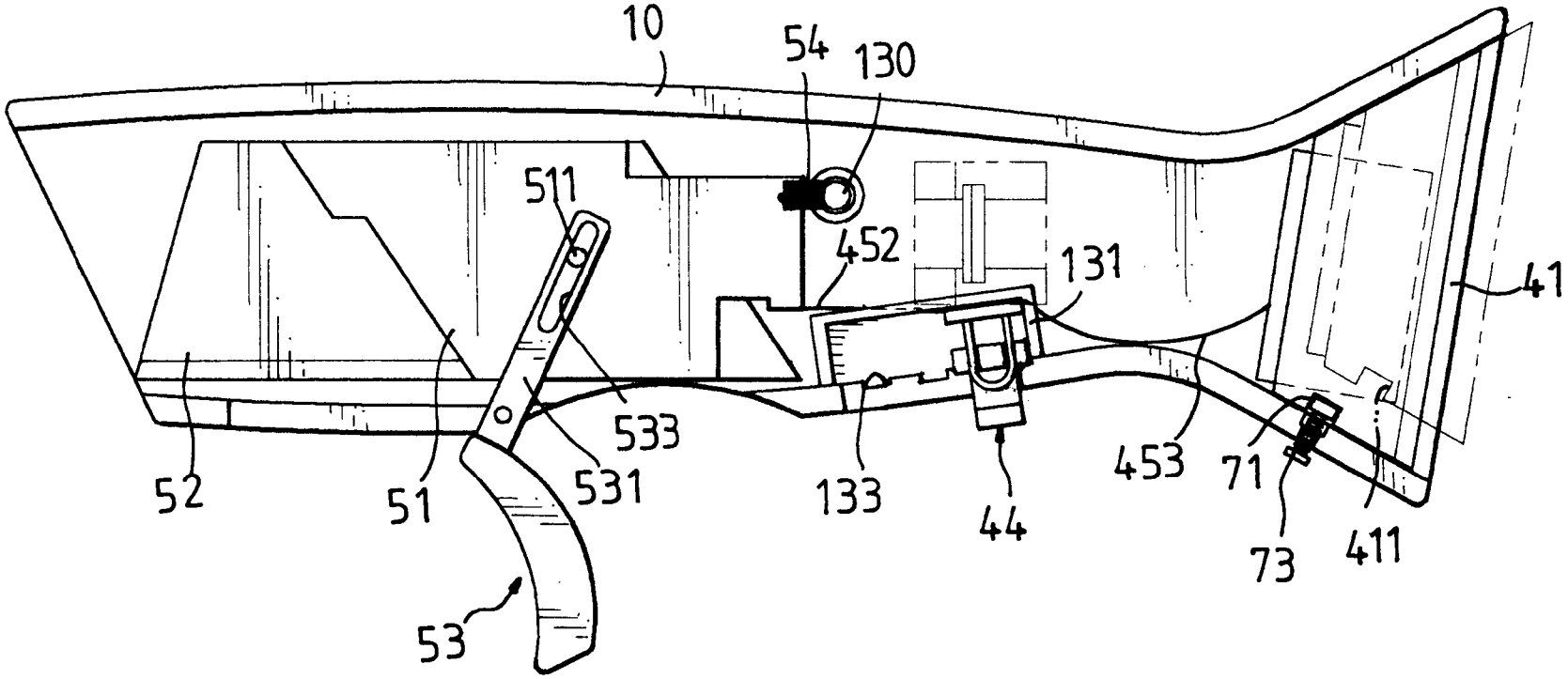
FIG. 5 is a side elevational view, partly removed, of the retractable knife device wherein the knob of the connecting device is moved toward the second blade which is then moved to extend from the casing.

Referring to FIGS. 4 and 5, when the knob 47 is positioned close to the first blade 52 as shown in FIG. 4, the trigger member 530 is pulled so that the plate 531 is pivoted to push the first blade 52 out from the casing, while the first and the second flexible rope 452, 453 are both pulled straight, the second blade 41 is therefore pulled to not be extended from the casing. In FIG. 5, when the knob 47 is pushed and then moved toward the second blade 41, the first flexible rope 452 is pulled straight to limit the first blade 52 from being moved and the second flexible rope 453 is loosened. A user pulls the end 73 away from the casing and the limit member 71 is removed from the recess 411 of the second blade 41. Then the pin member 43 is moved according to the processes mentioned above to move the body 40 together with the second blade 41 till the second flexible rope 453 is pulled straight. Therefore, the knife device can only be used one of two blades a time and a safety purpose is reached.

Figure 7:
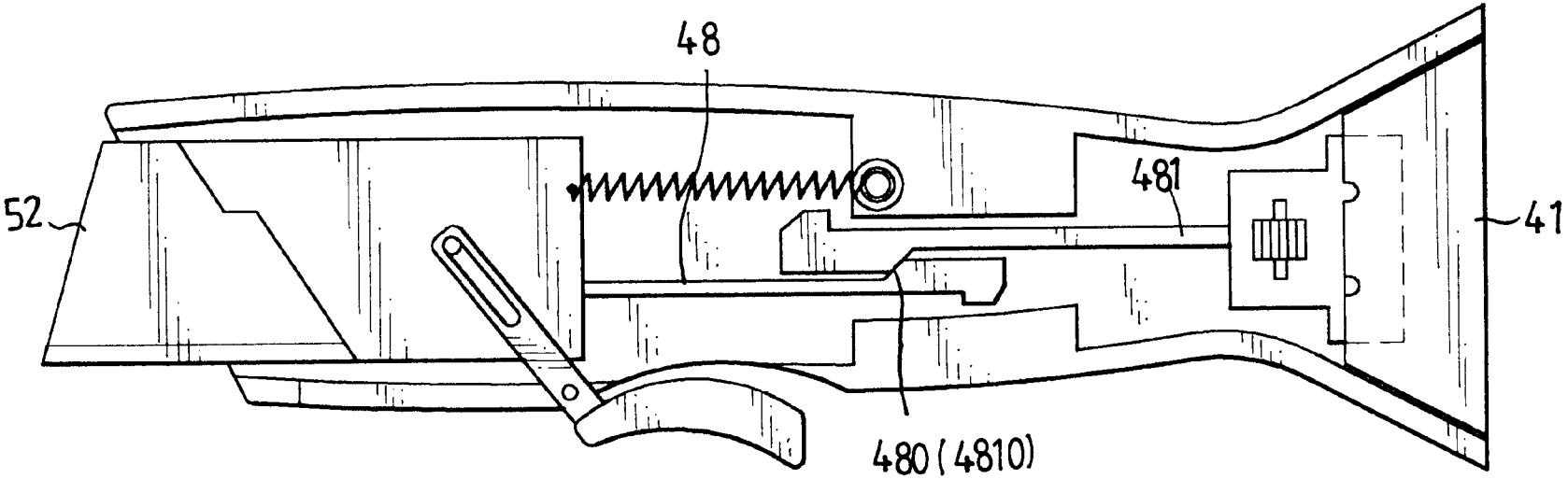
FIG. 7 is a side elevational view, partly removed, of a second embodiment of the connecting device.

FIG. 7 shows a second embodiment of the connecting device 44 that the two flexible ropes 452, 453 are replaced by two links includes 48, 481 and each of the two links 48, 481 has an engaging inclined surface 480/4810, wherein the two engaging inclined surfaces 480, 4810 are positioned to contact with each other so that whenever the first/second blade 52/41 is extended out from the casing, the second/first blade 41/52 is limited.

Figure 9:
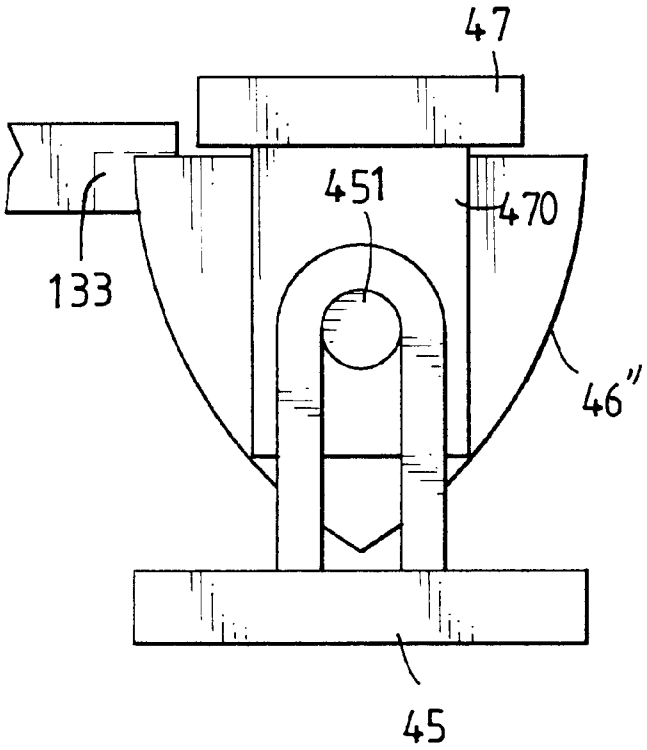
FIG. 9 is a side elevational view, partly removed, of a fourth embodiment of the connecting device.
Figure 8:
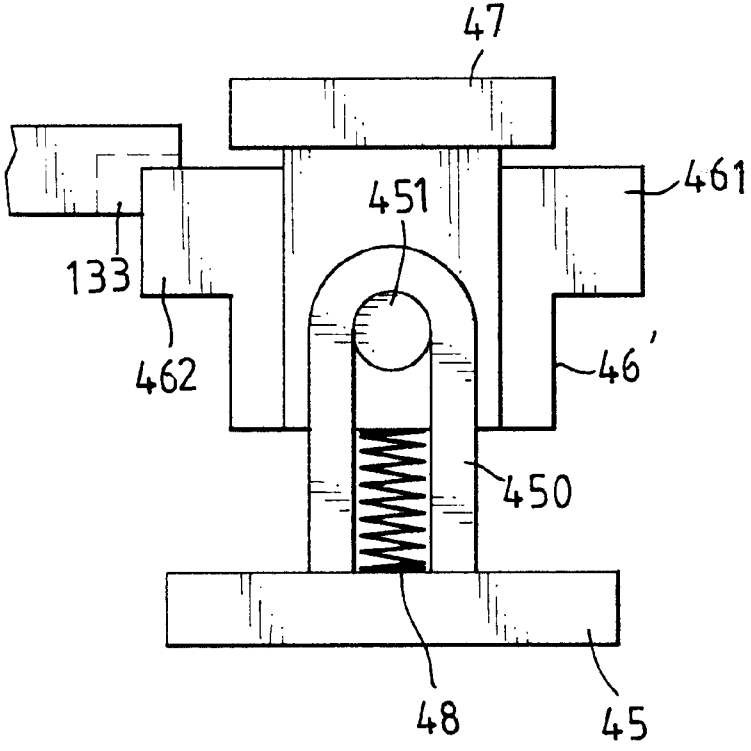
FIG. 8 is a side elevational view of a second embodiment of a third embodiment of the connecting device.

FIG. 8 shows a third embodiment of the connecting device 44 wherein the ring members 450 are disposed to the other two opposite sides of the board 45 and the middle member 46' is pivotally connected to the board 45 by the pin 451. The protrusions 462 is selectably received in one of the grooves 133. FIG. 9 shows a fourth embodiment of the connecting device 44 wherein the middle member 46" is a V-shaped flexible plate and the rib 470 of the knob 47 is received between two legs of the V-shaped flexible plate with a lower end of the rib 470 contacting the two legs so that the two legs are lowered, separated and removed from one of the grooves 133 by lowering the knob 47.

Although the invention has been explained in relation to its preferred embodiment, it is to be understood that many other possible modifications and variations can be made without departing from the spirit and scope of the invention as hereinafter claimed.

What is claimed is:

1. A retractable knife device comprising:

a casing having a first end into which a first member is retractably received and a second end into which a second member is retractably received, a connecting device connected between said first member and said second member so that only one of said first and said second member extends from said casing when in use, said connecting device having a knob slidably disposed to a side of said casing;

a trigger means including a trigger member and a plate which is transversely connected to one of two ends of said trigger member, said plate pivotally received in said casing and having a first slot defined therethrough into which a stub extending from said first member is movably received so that said first member is moved by pulling said trigger member, a spring having a first end thereof fixedly connected to said casing and a second end thereof connected to said first member, and said casing having an upper part through which a second slot is defined, a pin member movably extending through said second slot and a lower end of said pin member fixedly connected to said second member such that said second member is moved to extend from said second end of said casing by moving said pin member.

2. The retractable knife device as claimed in claim 1 wherein said casing includes said upper part and a lower part which is connected to said upper part which has an aperture defined by a T-shaped inner periphery, an engaging member extending from said lower part and having a vertical portion and a transverse portion which is perpendicularly connected to a top of said vertical portion such that said vertical portion extends through said aperture and said transverse portion is rested across said inner periphery defining said aperture.

3. The retractable knife device as claimed in claim 1 wherein said second member has a recess defined in a side thereof and a limit member is movably received in said recess, said limit member having an end exposed on said side of said casing so that when said limit member received in said recess, said second member is limited to be moved.

4. The retractable knife device as claimed in claim 1 wherein said casing has a plurality of grooves defined in an inner side of said side thereof and said connecting device includes a board having two ring members respectively disposed to two ends thereof, a middle member disposed between said knob and said board with a spring disposed between said middle member and said board, two protrusions extending in opposite with each other from said middle member and said protrusion received in one of said grooves, a pin extending through said two ring members and said knob so that said protrusion is lowered and moved to another groove by operating said knob.

5. The retractable knife device as claimed in claim 4 wherein said board has a first flexible rope extending therefrom which is fixedly connected to said first member and a second flexible rope extending therefrom which is fixedly connected to said second member.

6. The retractable knife device as claimed in claim 4 wherein said middle members a V-shaped flexible plate and said knob is received between two legs of said V-shaped flexible plate with a lower end of said knob contacting said two legs so that said two legs are lowered and removed from one of said grooves by lowering said knob.

* * * * *